US007332878B1

(12) United States Patent
Smith

(10) Patent No.: US 7,332,878 B1
(45) Date of Patent: Feb. 19, 2008

(54) ELECTRIC CANDLE FLAME SIMULATOR

(76) Inventor: David Eric Smith, 1890 Adare Dr., Clemmons, NC (US) 27012

( * ) Notice: Subject to any disclaimer, the term of this patent is extended or adjusted under 35 U.S.C. 154(b) by 0 days.

(21) Appl. No.: 11/525,754

(22) Filed: Sep. 22, 2006

(51) Int. Cl.
*H05B 37/02* (2006.01)
*F21V 1/00* (2006.01)
*F21V 5/00* (2006.01)

(52) U.S. Cl. ..... 315/299; 362/235; 362/240; 362/569

(58) Field of Classification Search ..... 315/291, 315/299, 360; 362/227, 230, 231, 234, 235, 362/236, 237, 240, 252, 569, 810
See application file for complete search history.

(56) References Cited

U.S. PATENT DOCUMENTS

| | | | | |
|---|---|---|---|---|
| 3,500,126 | A | 3/1970 | Ford | |
| 3,789,211 | A * | 1/1974 | Kramer | 362/231 |
| 4,064,414 | A * | 12/1977 | Bergeson et al. | 315/208 |
| 4,253,045 | A | 2/1981 | Weber | |
| 4,492,896 | A | 1/1985 | Jullien | |
| 4,510,556 | A | 4/1985 | Johnson | |
| 4,593,232 | A | 6/1986 | McEdwards | |
| 4,839,780 | A | 6/1989 | Chuan et al. | |
| 5,013,972 | A | 5/1991 | Malkieli et al. | |
| 5,097,180 | A | 3/1992 | Ignon et al. | |
| 5,600,209 | A | 2/1997 | St. Louis | |
| 5,924,784 | A | 7/1999 | Chliwnyj et al. | |
| 6,017,139 | A | 1/2000 | Lederer | |
| 6,066,924 | A | 5/2000 | Lederer | |
| 6,198,229 | B1 | 3/2001 | McCloud et al. | |
| RE37,168 | E | 5/2001 | St. Louis | |
| 6,719,443 | B2 | 4/2004 | Gutstein et al. | |
| 6,926,423 | B2 | 8/2005 | Bucher et al. | |
| 7,029,146 | B2 * | 4/2006 | Kitchen | 362/235 |
| 7,202,613 | B2 * | 4/2007 | Morgan et al. | 315/312 |
| 2002/0153850 | A1 | 10/2002 | Lederer | |
| 2003/0035291 | A1 | 2/2003 | Jensen et al. | |
| 2003/0161145 | A1 | 8/2003 | Liu et al. | |
| 2003/0198045 | A1 | 10/2003 | Kitchen | |
| 2005/0254248 | A1 * | 11/2005 | Lederer | 362/392 |
| 2006/0158881 | A1 * | 7/2006 | Dowling | 362/231 |
| 2006/0263733 | A1 * | 11/2006 | Furner et al. | 431/292 |
| 2007/0020572 | A1 * | 1/2007 | Furner et al. | 431/289 |
| 2007/0020573 | A1 * | 1/2007 | Furner et al. | 431/289 |

* cited by examiner

*Primary Examiner*—Thuy Vinh Tran
(74) *Attorney, Agent, or Firm*—Hiscock & Barclay, LLP; R. Stephen Rosenholm

(57) ABSTRACT

A method, apparatus and system for electrical simulation of a flame that provides for the projection of light that is a mixture of at least two colors. At least one of the two colors of light is projected over time according to a complex light intensity pattern. The complex light intensity pattern is constructed via an aggregation (superimposition) of a plurality of independent intensity transition signals. Each intensity transition signal represents a separate and varying intensity pattern. The complex light intensity pattern creates a perceptually real and pleasing visual effect upon the human eye, much like that created by the flickering of a real combustion flame and employs other than random or pseudo random intensity patterns.

20 Claims, 4 Drawing Sheets

ELECTRIC CANDLE FLAME SIMULATOR

FIELD OF THE INVENTION

This invention relates generally to an apparatus configured for electrical simulation of a flame, and in particular for simulation of a candle flame.

BACKGROUND OF THE INVENTION

The visual appearance of a flame is often pleasing to the human eye in some circumstances. Establishment and maintenance of a real combustion flame can be inconvenient and can create a significant safely risk to people and things located near it. As an alternative, an electrical simulation of a combustion flame can provide much of the visual effect of a combustion flame with less inconvenience and with substantially less risk to the safety of people and things located near it.

SUMMARY OF THE INVENTION

The invention provides for a method, apparatus and system for electrical simulation of a flame. In one aspect, the invention provides for the projection of light that is a mixture of at least two colors. At least one of the two colors of light is projected over time according to a complex light intensity pattern. The complex light intensity pattern is constructed via an aggregation (superimposition) of a plurality of independent intensity transition signals. Each intensity transition signal represents a separate and varying intensity pattern.

The complex light intensity pattern creates a perceptually real and pleasing visual effect upon the human eye, much like that created by the flickering of a real combustion flame and employs other than random or pseudo random intensity patterns which typically appear perceptually less real than the electrical simulation provided.

In some embodiments, the invention provides at least one lower and one upper light source that each generates light of a different color and of a different intensity pattern over time. Preferably and in some embodiments, the intensity pattern ranges between a dim and a bright light intensity and avoids a zero light intensity at any point in time during flame simulation. This creates a flame flicker pattern that does not "turn off", even for an imperceptibly small period of time, and that generally creates a more perceptibly real flame.

The foregoing as well as other objects, aspects, features, and advantages of the invention will become more apparent from the following description and from the claims.

BRIEF DESCRIPTION OF THE DRAWINGS

The objects and features of the invention can be better understood with reference to the claims and drawings described below. The drawings are not necessarily to scale; the emphasis is instead generally being placed upon illustrating the principles of the invention. Within the drawings, like reference numbers are used to indicate like parts throughout the various views. Differences between like parts may cause those like parts to be each indicated by different reference numbers. Unlike parts are indicated by different reference numbers.

DETAILED DESCRIPTION OF THE INVENTION

Figure 1:
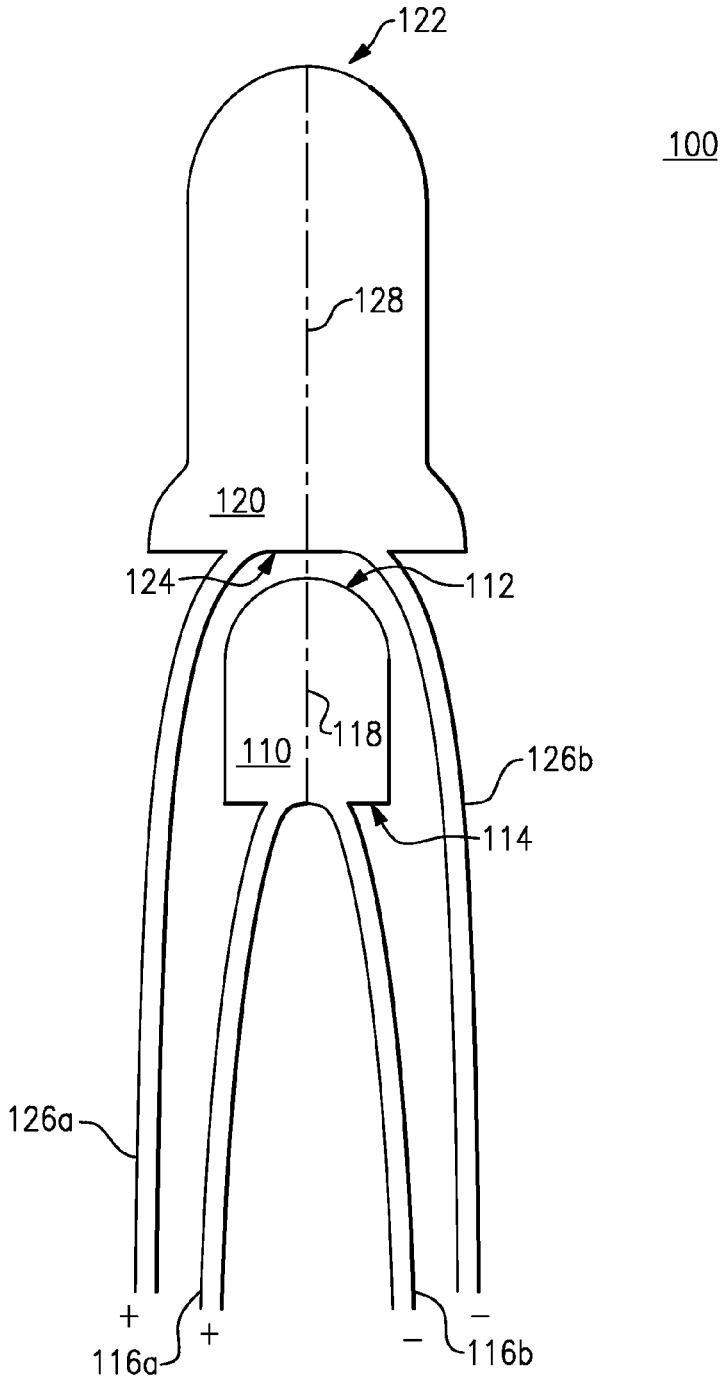
FIG. 1 illustrates an embodiment of a candle flame simulator including an arrangement of two light emitting diodes.

FIG. 1 illustrates an embodiment 100 of a candle flame simulator including an arrangement of two light emitting diodes (LEDs). As shown, a lower light emitting diode (LED) 110 is disposed below an upper light emitting diode (LED) 120. The lower LED 110 has an upper surface 112 and a lower surface 114 and a longitudinal axis 118 that intersects the upper 112 and lower 114 surfaces. The upper LED 120 has an upper surface 122 and a lower surface 124 and a longitudinal axis 128 that intersects the upper 122 and lower 124 surfaces.

In other embodiments, another type of light source, can substitute for either the upper 120 or lower 110 light emitting diode. For example, in some embodiments one or more electro-luminescent display devices function as a light source. In some other embodiments, one or more incandescent lights function as a light source.

As shown, the LEDs 110, 120 are arranged such that the upper surface 112 of the lower LED 110 is located proximate to the lower surface 124 of the upper LED 120 and that longitudinal axis 118 of the lower LED 110 is substantially aligned with the longitudinal axis 128 of the upper LED 120. With this arrangement, a substantial portion of light emitted from the upper surface 112 of said lower LED 110 passes through the lower surface 124 of the upper LED 120. In some embodiments, the upper surface 112 of the lower LED 110 abuts the lower surface 124 of the upper LED 120.

The lower LED 110 has two conductors (legs) **116*a*-116*b* protruding from its lower surface 114 and the upper LED 120 has two conductors (legs) 126*a*-126*b* protruding from its lower surface 124. The conductors 116*a*-116*b*, 126*a*-126*b* are each also referred to as electrodes 116*a*-116*b*, 126*a*-126*b*. Positively charged electric current flows into the lower LED 110 via the supply electrode 116*a* and out of the LED 110 via the return electrode 116*b*. Likewise, positively charged electric current flows into the upper LED 120 via the supply electrode 126*a* and out of the LED 120 via the return electrode 126*b***.

In this embodiment, the lower LED 110 is classified as a (3) millimeter LED and the upper LED 120 is classified as a (5) millimeter LED. Both LEDs 110, 120 are configured to receive electric current at less than or equal to (5) volts. In some embodiments, the electrodes (cathodes) **116*a* and 126*a* are electrically connected together and also connected to one source of voltage and positive current. In other embodiments, the electrodes (anodes) 116*b* and 126*b*** are electrically connected together and also connected to ground.

In some embodiments, the lower LED 110 is substantially a shade of blue and the upper LED 120 is substantially a shade of yellow. Preferably, the shade of blue is of an optical wavelength of approximately 468 nanometers and the shade of yellow is of a optical wave length of approximately 589 nanometers.

Figure 2:
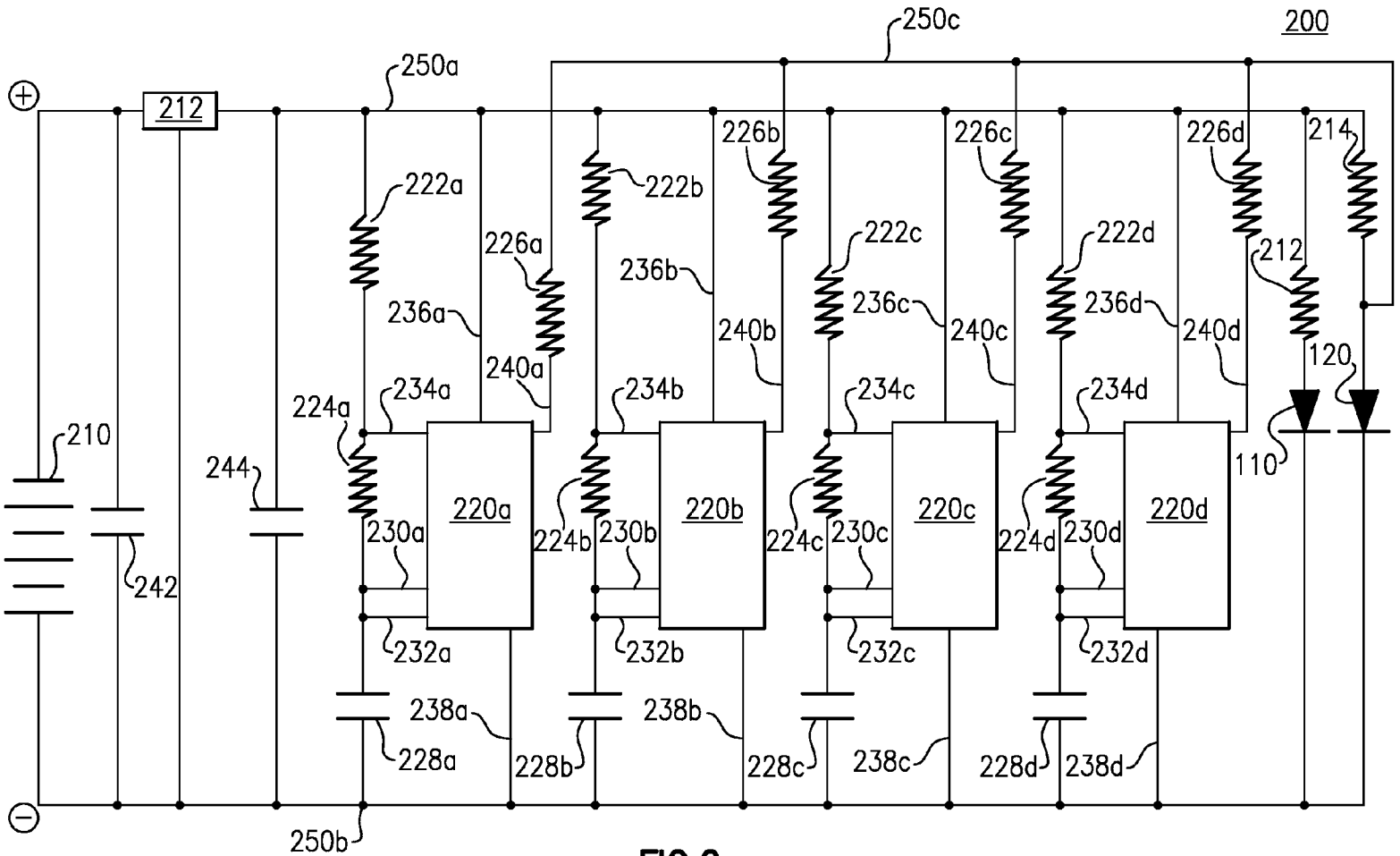
FIG. 2 illustrates a first embodiment of a five volt supplied electronic circuit configured to generate a supplemental intensity signal that includes a superimposition of four individual intensity transition signals.

FIG. 2 illustrates a first embodiment 200 of a five volt supplied electronic circuit configured to generate a supplemental intensity signal that includes a superimposition of four individual intensity transition signals. As shown, the electronic circuit 200, also referred to as a circuit 200, includes a (5) volt voltage source 210 supplying positively charged current through a voltage regulator 212 that is configured to maintain its output voltage at (5) volts.

The circuit 200 also includes (4) integrated circuit (IC) timer components 220*a*-220*d*. In this embodiment, the timer components 220*a*-220*d* are known as 555 timers that are supplied from numerous sources, including but not limited to Motorola and Texas Instruments. The timers 220*a*-220*d* can be implemented using such as NE556 component, which is equivalent to (2) NE555's sharing the same positive and negative connections. The timers 220*a*-220*d* are electrically connected to the circuit 200 in a standard configuration, known as an "astable" configuration.

Each 555 timer 220*a*-220*d*, also referred to as timers 220*a*-220*d*, has (8) external electrodes, referred to as PINS, that are each identified by a unique number (1-8). A PIN number (1) of the 555 timers 220*a*-220*d* is a ground (common) PIN, a PIN number (2) is a trigger PIN, a PIN number (3) is an output PIN, a PIN number (4) is a reset PIN, a PIN number (5) is a control voltage PIN, a PIN number (6) is a threshold PIN, a PIN number (7) is a discharge PIN and a PIN number (8) is a (positive) supply voltage PIN.

The 555 timers 220*a*-220*d* each receive a supply voltage via the supply voltage PIN 236*a*-236*d* (PIN number (8)), that is electrically connected to a voltage supply conductor 250*a* that is connected to an output of the voltage regulator 212. The discharge PIN 234*a*-234*d* (PIN number (7)) for each timer 220*a*-220*d* is each electrically connected between an upper input resistor 222*a*-222*d* and a lower input resistor 224*a*-224*d*. The trigger PIN 232*a*-232*d* (PIN number (2)) and the threshold PIN 230*a*-230*d* (PIN number (6)) are each connected between the lower input resistor 224*a*-224*d* and a capacitor 228*a*-228*d* respectively. Each output PIN 240*a*-240*d* respectively connects each timer 220*a*-220*d* to an output resistor 226*a*-226*d*. Each ground PIN 238*a*-238*d* respectively connects each timer 220*a*-220*d* to a voltage return (ground) conductor 250*b*.

Each timer 220*a*-220*d* is configured to set a voltage on the output PIN 240*a*-240*d* that is equal to (5) volts when the voltage detected by the discharge PIN 234*a*-234*d* is less than or equal to ⅔ of the supply voltage. Each timer 220*a*-220*d* is configured to set a voltage on the output PIN 240*a*-240*d* equal to (0) volts when the voltage detected by the discharge PIN 234*a*-234*d* is greater than or equal to ⅔ of the supply voltage.

The output 240*a*-240*d* of each timer 220*a*-220*d* generates an intensity transition signal that causes current to flow or not to flow through each output resistor 226*a*-226*d* respectively, and towards an input 126*a* of the upper LED 120 at a particular time. The upper LED 120 emits light in response to each flow (burst) of current that is supplied into its input 126*a*.

The lower LED 110 receives current that travels through the voltage supply conductor 250*a* and a resistor 212 via its input conductor 116*a*. This current constitutes a first intensity signal received by the lower LED 110. The intensity of the light emitted from the lower LED 110 over time is a response to the first intensity signal.

The upper LED 120 receives via its input conductor 126*a*, current that travels through the voltage supply conductor 250*a* and a resistor 214, and additionally receives current that travels through a supplemental conductor 250*c*. The current that travels through the supplemental conductor 250*c* is generated from the outputs 226*a*-226*d* of the (4) timers 220*a*-220*d*. The current supplied from the voltage supply conductor 250*a* constitutes a base intensity signal that is received by the upper LED 120. The current collectively supplied from the outputs 226*a*-226*d* of the (4) timers 220*a*-220*d* merges along the supplemental conductor 250*c* and collectively constitutes a supplemental intensity signal that is received by the upper LED 120. The supplemental intensity signal is a superimposition of the intensity transition signals that are collectively generated by the (4) timers 220*a*-220*d*.

The current supplied from the voltage supply conductor 250*a* constitutes a base intensity signal that is received by the upper LED 120. The current collectively supplied from the outputs 226*a*-226*d* of the (4) timers 220*a*-220*d* merges along the supplemental conductor 250*c* and collectively constitutes a supplemental intensity signal that is received by the upper LED 120. The supplemental intensity signal is an aggregation (superimposition) of the intensity transition signals that are collectively generated by the (4) timers 220*a*-220*d*.

The supplemental intensity signal supplied by the supplemental conductor 250*c* merges with the base intensity signal supplied by the voltage supply conductor 250*a* to constitute a second intensity signal. The second intensity signal is a superimposition of the base intensity signal and the supplemental intensity signal. The second intensity signal is received by the upper LED 120 via its input 126*a* conductor. The intensity of the light emitted from the upper LED 120 over time is a response to the second intensity signal.

In one particular embodiment, each of the resistors 222*a*-222*d* is configured for 10 Kohms of resistance, resistor 224*a* is configured for 470 Kohms of resistance, resistor 224*b* is configured for 100 Kohms of resistance, resistor 224*c* is configured for 33 Kohms of resistance and resistor 224*d* is configured for 6.8 Kohms of resistance. Each of the resistors 226*a*-226*c* is configured for 680 Ohms of resistance. Resistor 226*d* is configured for 470 Ohms of resistance. Resistor 212 is configured for 1 Kohm and resistor 214 is configured for 150 Ohms of resistance.

Also in this particular embodiment, each of the capacitors 228*a*-228*d* are configured for 10 micro-farads of capacitance. Also a first additional capacitor 242 connected between conductors 250*a* and 250*b* and connected at the input (upstream) of the voltage regulator 212 is configured for 0.33 micro-farads. Also a second additional capacitor 244 connected between conductors 250*a* and 250*b* and at the output (downstream) of the voltage regulator 212 is configured for 0.1 micro-farads. The first and second additional capacitors are connected in parallel with respect to each other and with respect to the voltage regulator 212. The voltage regulator 212 is an L78L05 rated voltage capacitor.

Figure 3:
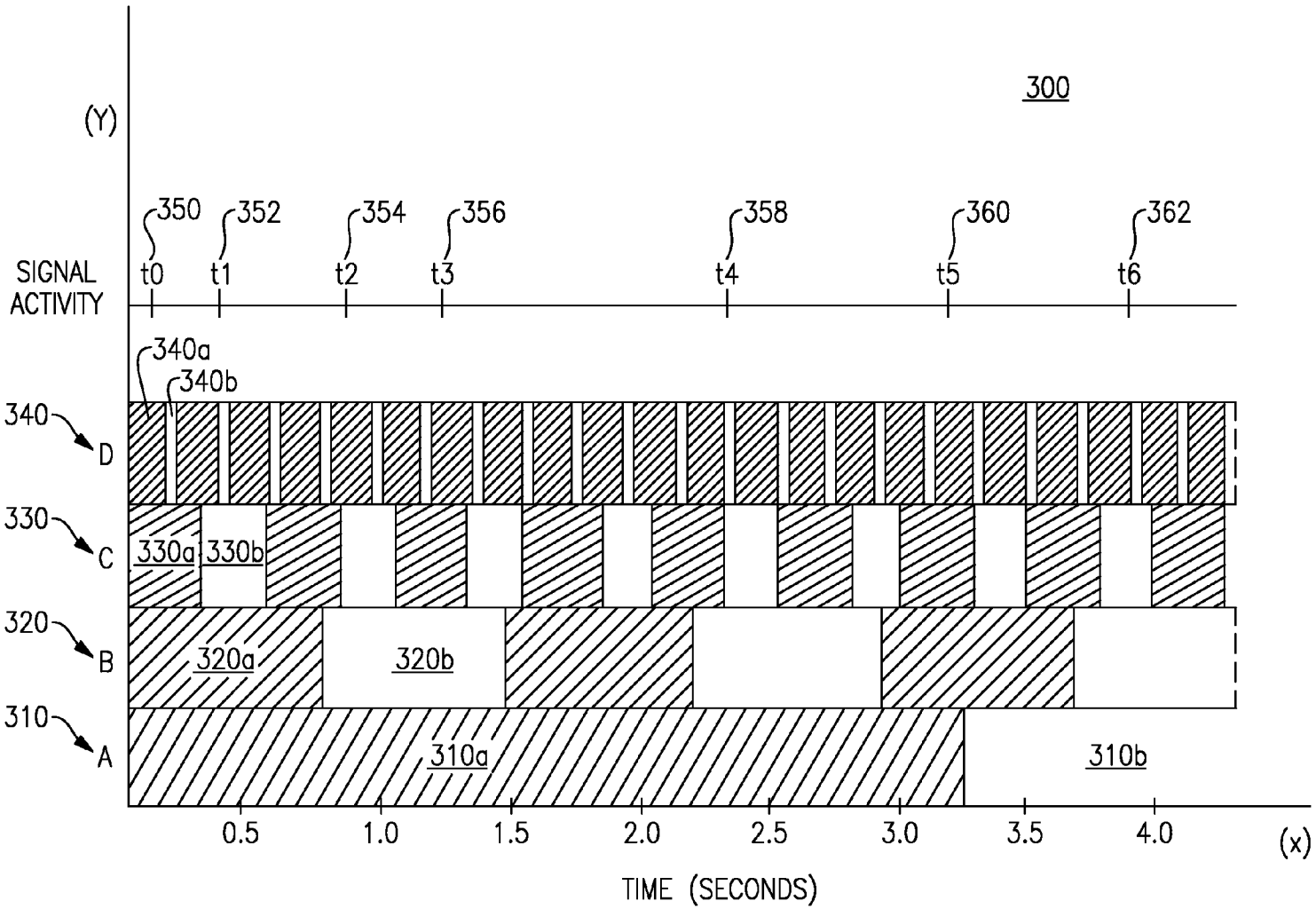
FIG. 3 illustrates a graphical representation of an example of the four intensity transition signals that can be collectively generated over time by the electrical circuit of FIG. 2.

FIG. 3 illustrates a graphical representation of an example of the four intensity transition signals that can be collectively generated over time by the electrical circuit of FIG. 2. As shown, a vertical (Y) axis indicates an act of generating of an intensity transition signal by a particular timer 220*a*-220*d*. A signal generating action of each timer 220*a*-220*d* is represented indicated by the symbols A through D, respectively. A horizontal axis (X) indicates a span of time within which an act of generating an intensity transition signal can occur.

For this example, the timer 220*a* generates an intensity transition signal 310, represented by the row labeled (A) 310, having a period of approximately 6.5 seconds. Within the 6.5 second signal cycle, the timer 220*a* outputs a signal amplitude equal to (5) volts via its output PIN number (3) for a duration of time approximately equal to 3.3 seconds (fully shown and indicated by a cross-hatch area pattern) 310*a*, and then outputs a signal amplitude equal to (0) volts via its output PIN number (3) for a duration of time approximately 3.2 seconds (partially shown and indicated by the absence of an area pattern) 310*b*, to complete the 6.5 second signal period.

For this example, the timer 220*b* generates an intensity transition signal 320, represented by the row labeled (B) 320, having a period of approximately 1.5 seconds. Within the 1.5 second signal cycle, the timer 220*b* outputs a signal amplitude equal to (5) volts via its output PIN number (3) for a duration of time approximately equal to 0.8 seconds (fully shown and indicated by a cross-hatch area pattern) 320*a*, and then outputs a signal amplitude equal to (0) volts via its output PIN number (3) for a duration of time approximately 0.7 seconds (fully shown and indicated by the absence of an area pattern) 320*b*, to complete the approximately 1.5 second signal period.

For this example, the timer 220*c* generates an intensity transition signal, represented by the row labeled (C) 330, having a period of approximately 0.5 seconds. Within the 0.5 second signal cycle, the timer 220*c* outputs a signal amplitude equal to (5) volts via its output PIN number (3) for a duration of time approximately equal to 0.3 seconds (fully shown and indicated by a cross-hatch area pattern) 330*a*, and then outputs a signal amplitude equal to (0) volts via its output PIN number (3) for a duration of time approximately 0.2 seconds (fully shown and indicated by the absence of an area pattern) 330*b*, to complete the approximately 0.5 second signal period.

For this example, the timer 220*d* generates an intensity transition signal, represented by the row labeled (D) 340, having a period of approximately 0.2 seconds. Within the 0.2 second signal cycle, the timer 220*d* outputs a signal amplitude equal to (5) volts via its output PIN number (3) for a duration of time approximately equal to 0.15 seconds (fully shown and indicated by a cross-hatch area pattern) 340*a*, and then outputs a signal amplitude equal to (0) volts via its output PIN number (3) for a duration of time approximately equal to 0.05 seconds (fully shown and indicated by the absence of an area pattern 340*b*), to complete the approximately 0.2 second signal period. The generation of each intensity transition signal is repeated while simulating a flame.

As shown, at a time equal to t0 350, all (4) intensity transition signals (A) 310, (B) 320, (C) 330 and (D) 340 are at a high amplitude 310*a*, 320*a*, 330*a*, 340*a* and supplying current to the upper LED 120. In other words, the signals (A) 310, (B) 320, (C) 330 and (D) 340 are said to be "high". At a time equal to t1 352, the signals (A) 310 and (B) 320 are high and signals (C) 330 and (D) 340 are low.

At a time equal to t2 354, signals (A) 310 and (D) 340 are high and signals (B) 320 and (C) 330 are low. At a time equal to t3 356, signals (A) 310, (C) 330 and (D) 340 are high and only signal (B) 320 is low. At a time equal to t4 358, only signal (A) 310 is high and signals (B) 320, (C) 330 and (D) 340 are low. At time equal to t5 360, all (4) intensity transition signals (A) 310, (B) 320, (C) 330 and (D) 340 are again at a high. At time equal to t6 362, all (4) intensity transition signals (A) 310, (B) 320, (C) 330 and (D) 340 are low and none of the signals 310-340 are high.

But notice that the substantially uniform base intensity signal that travels through the conductor 250*a* and mixes (modulates) with the intensity transition signals 310-340 before passing through the upper LED 120. Hence, in this preferred embodiment, the intensity of the upper LED 120 remains equal to a value greater than zero, that of the base intensity signal, so that the intensity of the upper LED 120 dims but not reach an intensity value equal to zero so that the intensity of the upper LED 120 is not turned off at any time during the operation of the upper LED 120. In other embodiments, the base intensity signal is a non-zero and a substantially varying signal.

Likewise, in this preferred embodiment, the intensity of the lower LED 110 (not shown) has a substantially uniform intensity and remains equal to a value greater than zero so that the collective intensity of the LEDs 110, 120 dims but not reach an intensity value equal to zero so that the collective intensity of the LEDs 110, 120 is not turned off at any time during the operation of the flame simulator 100.

In the above described preferred embodiment, neither the LEDs 110, 120 are "intermittent". Neither of the LEDs intermittently turn on and off like much of the prior art.

The duration of each signal period, and the apportionment of its high amplitude and its low amplitude, are configured according to the electronic components connected with each of the 555 timers 220*a*-220*d*. As specified by the design of the 555 timers 220*a*-220*d*, the high amplitude portion (H) of each signal period is determined by the equation:

$$(H)=(0.693)*(\text{Upper Resistor Resistance}+\text{Lower Resistor Resistance})*(\text{Capacitor Capacitance}) \quad \text{a.}$$

The low amplitude portion (L) of each signal period is determined by the equation:

$$(L)=(0.693)*(\text{Lower Resistor Resistance})*(\text{Capacitor Capacitance}) \quad \text{b.}$$

As shown in FIG. 3, each signal period for the intensity transition signals (A) 310, (B) 320, (C) 330 and (D) 340 is apportioned (divided) between a high amplitude (5 volt) portion and a low amplitude (0 volt) portion. Despite the simplicity of each intensity transition signal waveform, the aggregation of the (A) 310, (B) 320, (C) 330 and (D) 340 signal waveforms constructs a complex waveform that does not resemble any of the individual intensity transition signal waveforms 310-340.

Referring to FIG. 2, for example, with respect to the (A) timer 220*a*, if its upper resistor 222*a* has a resistance of 10 kohms and its lower resistor 224*a* has a resistance of 470 kohms, and its capacitor 228*a* has a capacitance of 10 microfarads, then the high amplitude portion (H) and the low amplitude portion (L) of each signal period generated by the timer output is equal to:

$$(H)=(0.693)*(10000\text{ ohms}+470{,}000\text{ ohms})*(0.00001)\text{ microfarads}=3.32\text{ seconds.}$$

$$(L)=(0.693)*(470{,}000\text{ ohms})*(0.00001)\text{microfarads}=3.26\text{ seconds.}$$

This yields a signal period equal to (3.32 seconds)+(3.26 seconds)=6.58 seconds.

Hypothetically, raising the lower resistor resistance 224*a* to 500,000 ohms alters (H) and (L) to be:

$$(H)=(0.693)*(10000\text{ ohms}+500{,}000\text{ ohms})*(0.00001)\text{ microfarads}=3.53\text{ seconds.}$$

$$(L)=(0.693)*(500{,}000\text{ ohms})*(0.00001)\text{microfarads}=3.47\text{ seconds.}$$

This yields a larger signal period equal to approximately 7 seconds.

The actual current generated during the generation of the high amplitude portion of an intensity transition signal is dependent upon the resistance value of the output resistor

226*a* for the (A) intensity transition signal 310, dependent upon the resistance value of the output resistor 226*b* for the (B) intensity transition signal 320, dependent upon the resistance value of the output resistor 226*c* for (C) intensity transition signal 330, and dependent upon the resistance value of the output resistor 226*d* for (D) intensity transition signal 340.

For example, if the output resistor 226*a* of the (A) timer 220*a* is configured to have a resistance of 1000 ohms, then the (A) intensity transition signal current would equal ((5 volts/1000 ohms)=0.005 amps) during the high signal amplitude portion 310*a* of the (A) intensity transition signal period and ((0 volts/1000 ohms)=0.0 volts) during the low signal amplitude portion 310*b* of the (A) intensity transition signal period.

Likewise for example, if the output resistor 226*c* of the (C) timer 220*c* is configured to have a resistance of 400 ohms, then the (C) intensity transition signal current would equal ((5 volts/400 ohms)=0.0125 amps) during the high signal amplitude portion 330*a* of the (C) intensity transition signal period and (0 volts/1000 ohms=0.0 volts) during the low signal amplitude portion 330*b* of the (A) intensity transition signal period.

The current supplied by the first intensity signal for the lower LED 110 travels through the voltage supply conductor 250*a* and through the resistor 212 before entering the lower LED 110 via its input electrode 116*a*. The amount of this current supplied by the first intensity signal is approximately equal to 5 volts minus the voltage drop across the lower LED 110, divided by the resistance value of resistor 212.

For example, when the resistance of the resistor 212 is 1000 ohms and when the voltage drop across the lower LED 110 is about 2.4 volts, then the base intensity signal current is approximately ((5 volts−2.4 volts)/1000 ohms=0.0026 amps).

The current supplied by the base intensity signal for the upper LED 120 travels through the voltage supply conductor 250*a* and through the resistor 214 before entering the upper LED 120 via its input electrode 126*a*. The amount of this current supplied by the base intensity signal is approximately equal to 5 volts minus the voltage drop across the upper LED 120, divided by the resistance value of resistor 214.

For example, when the resistance of the resistor 214 is 150 ohms and when the voltage drop across the upper LED 120 is about 2.4 volts, then the base intensity signal current is approximately ((5 volts−2.4 volts)/150 ohms=0.017 amps).

Figure 4:
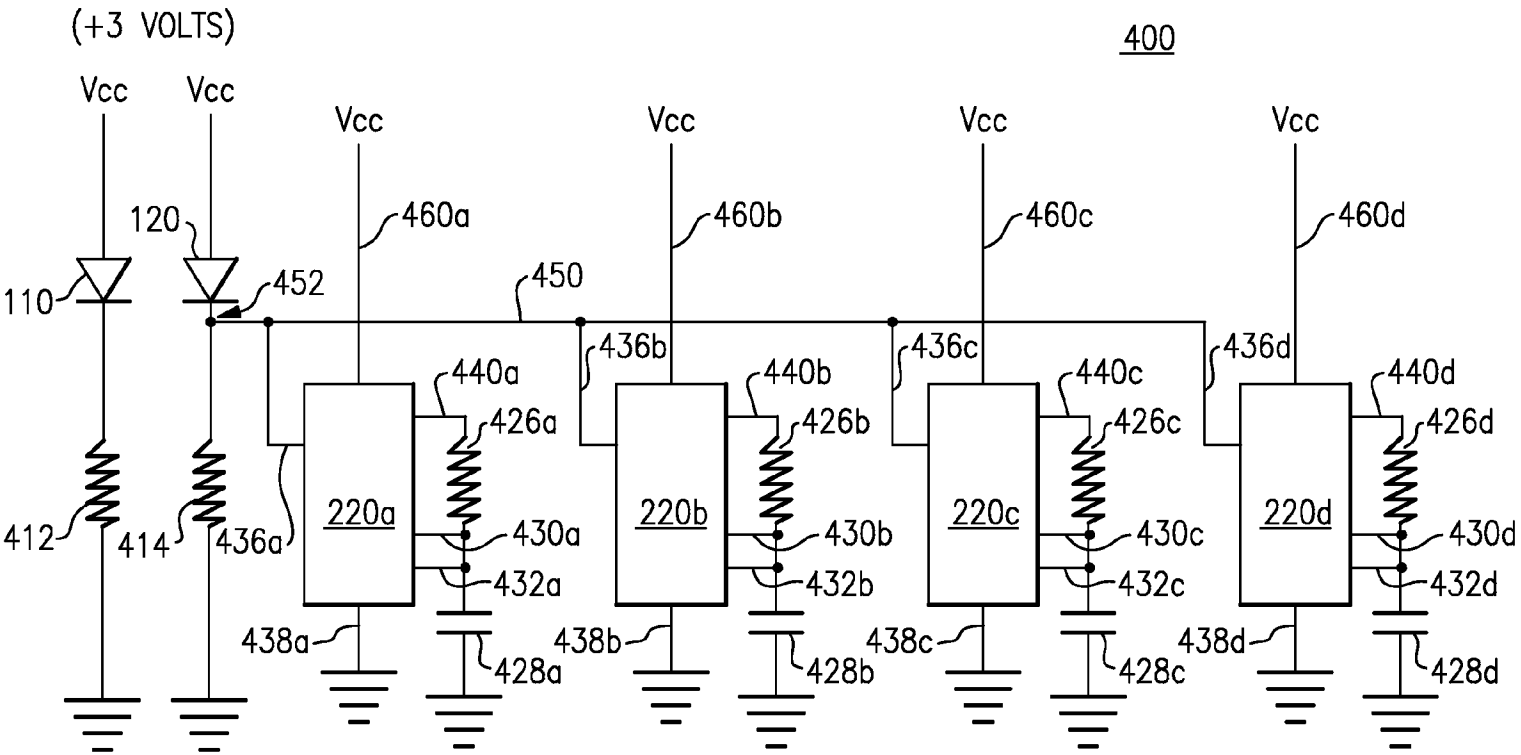
FIG. 4 illustrates a second embodiment of a three volt supplied electronic circuit configured to generate a supplemental intensity signal that includes a superimposition of four individual intensity transition signals.

FIG. 4 illustrates an alternative embodiment 400 of a three volt supplied electronic circuit configured to generate a supplemental intensity signal that includes a superimposition of four individual intensity transition signals. As shown, the electronic circuit 400, also referred to as a circuit 400, includes a (3) volt voltage source supplying positively charged current to the lower LED 110 and to the upper LED 120.

The flow of current through the lower LED 110 is restricted (limited) by a resistor 412, located downstream of the lower LED 110. This flow of current constitutes a first intensity signal received by the lower LED 110. Also, the flow of current through the upper LED 120 is restricted (limited) by a resistor 414. This flow of current constitutes a base intensity signal received by the upper LED 120.

The circuit 400 also includes (4) integrated circuit (IC) 555 timer components 220*a*-220*d* as shown in FIG. 2. As described in FIG. 2, the timer components 220*a*-220*d* are known as 555 timers that are supplied from numerous sources, including but not limited to Motorola and Texas Instruments.

However, in contrast to FIG. 2, the timers 220*a*-220*d* are electrically connected to the circuit 400 differently than the timers 220*a*-220*d* shown in FIG. 2 and in a non-standard configuration. In this non-standard configuration, the timers 220*a*-220*d* collectively drain current at a circuit location 452 downstream of the output of the upper LED 120. The timers 220*a*-220*d* do not supply current to the input (upstream) of the upper LED 120 as described for FIG. 2. In response to draining current at the output (downstream) of the upper LED 120, more current is be supplied to the upper LED 120.

As described with respect to FIG. 2, each timer 220*a*-220*d* has (8) external electrodes, referred to as PINS, that are each identified by a unique number (1-8). The 555 timer PIN number (1) is a ground (common) PIN, PIN number (2) is a trigger PIN, PIN number (3) is an output PIN, PIN number (4) is a reset PIN, PIN number (5) is a control voltage PIN, PIN number (6) is a threshold PIN, PIN number (7) is a discharge PIN and PIN number (8) is a (positive) supply voltage PIN.

The 555 timers 220*a*-220*d* each receive a supply voltage (Vcc) via the supply voltage PIN 460*a*-460*d* (PIN number (8)). The discharge PIN 436*a*-436*d* (PIN number (8)) for each timer 220*a*-220*d* is electrically connected to the voltage drain conductor 450. The voltage drain conductor is electrically connected at circuit location 452 which is downstream of the output of the upper LED 120.

Each timer 220*a*-220*d* is configured to set a voltage on the output PIN 440*a*-440*d* (PIN number 3) to (5) volts when the voltage measured downstream of an output resistor 426*a*-426*d* is less than or equal to ⅔ of the supply voltage. as detected by the discharge PIN (PIN number (7)). Each timer 220*a*-220*d* is configured to set a voltage on the output PIN 440*a*-440*d* to (0) volts when the voltage measured downstream of the output resistor 426*a*-426*d* is greater than or equal to ⅔ of the supply voltage. as detected by the discharge PIN (PIN number (7)).

The output resistor 426*a*-426*d* is located in series with and downstream (with respect to the flow of positive current) of the output PIN 440*a*-440*d* (PIN number 3). The trigger PIN 232*a*-232*d* (PIN number (2)) and the threshold PIN 230*a*-230*d* (PIN number (6)) are each connected on a downstream side of the output resistor 426*a*-426*d* for detection of voltage at that circuit location. Each ground PIN 438*a*-438*d* respectively connects each timer 220*a*-220*d* to a ground potential.

The output 440*a*-440*d* of each timer 220*a*-220*d* generates an intensity transition signal that causes current to flow or not to flow through each output resistor 426*a*-426*d* respectively, and towards a capacitor 428*a*-428*d* at particular points in time. The current flowing through the output resistor 426*a*-426*d* is being drawn by the timer 220*a*-220*d* from a circuit location 452 located downstream of the upper LED 120, causing additional current to flow through the upper LED 120. When the amplitude of each output PIN 440*a*-440*d* (PIN number 3) is high (5 volts), current and charge flows into and is stored by the capacitor 428*a*-428*d*. When the amplitude of each output PIN 440*a*-440*d* (PIN number 3) is low (0 volts) current and charge flows out of the capacitor 428*a*-428*d* and to ground via the output PIN (PIN number 3).

In this embodiment, the supplemental intensity signal is generated by the additional flow of current passing through the upper LED 120 caused by the collective current drainage of the (4) timers 220*a*-220*d*. The drainage of each timer 220*a*-220*d* constitutes a separate intensity transition signal. The current collectively drained by the (4) timers 220*a*-220*d* causes the additional current to flow through the upper LED 120. The additional current flowing through the upper LED 120 collectively constitutes a supplemental intensity signal that passes through and is received by the upper LED 120. The supplemental intensity signal is a superimposition of the drainage of each timer 220*a*-220*d*.

When the amplitude of the output signal (PIN number 3) 440*a*-440*d* of each timer 220*a*-220*d* is high, the current that is being output through the output PIN 440*a*-440*d* is also being input (drained) into the timer 220*a*-220*d* via the discharge PIN (PIN number 7) 434*a*-434*d*. The current being input (drained) into the timer 220*a*-220*d* is being drawn (sourced) from a circuit location 452 downstream of the output of the upper LED 120. Drawing current from the circuit location 452 causes more current to pass through the upper LED 120 causing the upper LED 120 to emit light at a higher intensity in response to the more current passing through it.

When the amplitude of the output signal (PIN number 3) 440*a*-440*d* of each timer 221-220*d* is low, no current is being drawn by the timer 220*a*-220*d* from the circuit location 452. Not drawing current from the circuit location 452 causes less current to pass through the upper LED 120 and causes the upper LED 120 to emit light at a lower intensity in response to the less current passing through it.

Optionally, resistors (not shown) can be added at one or more locations along the voltage drain conductor 450 to decrease the amount of current drained by the timers 220*a*-220*d*. A resistor (not shown) disposed along the voltage drain conductor 450 at a location upstream of the drainage caused by one or more timers 220*a*-220*d* reduces the current drained by those timers. Such resistors can be disposed so that the intensity of the longer aspects of the flicker of the upper LED 120 can be reduced.

In other embodiments, other combinations of LEDs 110, 120 of different types, sizes and ratings and colors can be employed. For example, a 5 mm LED can be disposed below a 10 mm LED or a white LED can be disposed above a yellow LED, or vice versa. In some embodiments, rectangular LEDs 110, 120, such as including one or more 2 mm by 5 mm LEDs are employed.

In some embodiments, the lower LED 110 and the upper LED 120, of the same or different sizes, are encapsulated in a single translucent LED. In some embodiments, a first cluster of LEDs are disposed below a second cluster of LEDs.

In some embodiments, arrangements including other than (4) timers 220*a*-220*d* are utilized to create flame effects of differing complexity and character. For example, in some embodiments, (2) timers 220*a*-220*d* are employed while in other embodiments, (6) timers 220*a*-220*d* are employed.

Embodiments of the invention are not limited to those employing a 555 timer 220*a*-220*d*. For example, in other embodiments, one or more intensity transition signals are generated by digital logic components including a crystal resonator and/or programmable microcontroller.

While the present invention has been explained with reference to the structure disclosed herein, it is not confined to the details set forth and this invention is intended to cover any modifications and changes as may come within the scope and spirit of the following claims.

What is claimed is:

1. A candle flame simulator comprising:

a lower light source that is configured to continuously emit a light of a first color and of a first intensity, said first intensity being a non-zero intensity over time;

an upper light source that is configured to continuously emit a light of a second color and of a second intensity, said second intensity being a non-zero and a substantially varying intensity over time; and where said second intensity is generated in response to a second intensity signal, said second intensity signal being a combination of a base intensity signal and a supplemental intensity signal and where said base intensity signal represents a non-zero intensity over time and where said supplemental intensity signal represents a substantially varying intensity over time and where said supplemental intensity signal is an aggregation of a plurality of individual intensity transition signals that each represent a separate varying intensity over time.

2. The candle flame simulator of claim 1 where each of said intensity transition signals has a separate associated phase, separate associated period and separate associated apportionment of said period between at least two different intensity values.

3. The candle flame simulator of claim 1 where said second intensity signal has a non-zero minimum and maximum intensity value over time and where a difference of intensity between said minimum and maximum intensity value is apparent to the human eye.

4. The candle flame simulator of claim 1 where said supplemental intensity signal is an aggregation of at least four separate intensity transition signals.

5. The candle flame simulator of claim 1 where said lower light source is a lower light emitting diode that has a translucent upper surface and said upper light source is an upper light emitting diode that has a lower translucent surface and where said upper surface of said lower light emitting diode is disposed within close proximity of said lower surface of said upper light emitting diode so that a substantial portion of light emitted from said upper surface of said lower light emitting diode passes through said lower surface of said upper light emitting diode.

6. The candle flame simulator of claim 5 where said upper surface of said lower light emitting diode abuts said lower surface of said upper light emitting diode.

7. The candle flame simulator of claim 5 where said upper surface of said lower light emitting diode is located within 2 millimeters of said lower surface of said upper light emitting diode.

8. The candle flame simulator of claim 5 where said upper light emitting diode includes two protruding lower legs and where said lower light emitting diode is disposed substantially between said two protruding lower legs.

9. The candle flame simulator of claim 5 where said upper light emitting diode is dimensioned as a 5 millimeter light emitting diode and said lower light emitting diode is dimensioned as a 3 millimeter light emitting diode.

10. The candle flame simulator of claim 1 where said first color is substantially a shade of blue and where said second color is substantially a shade of yellow.

11. The candle flame simulator of claim 10 where said shade of blue is of an optical wavelength of approximately 468 nanometers and said shade of yellow is of a optical wave length of approximately 589 nanometers.

12. The candle flame simulator of claim 1 where said supplemental intensity signal is an aggregation of at least three separate intensity transition signals.

13. The candle flame simulator of claim 1 where said supplemental intensity signal is an aggregation of less than or equal to six separate intensity transition signals.

14. The candle flame simulator of claim 1 where said upper light emitting diode and said lower light emitting diode are enclosed within a translucent structure.

15. The candle flame simulator of claim 1 where said first intensity is a substantially non-uniform intensity over time.

16. The candle flame simulator of claim 1 where said lower and upper light emitting diodes are disposed among one or more other light sources.

17. The candle flame simulator of claim 1 where said second intensity signal is generated at least in part from an electronic circuit including a plurality of 555 timers that are configured to output current that passes through at least said upper light emitting diode.

18. The candle flame simulator of claim 1 where said second intensity signal is generated at least in part from an electronic circuit including a plurality of 555 timers that are configured to drain current that passes through at least said upper light emitting diode.

19. The candle flame simulator of claim 1 where at least one light source is implemented as an electro-luminescent display or as an incandescent light.

20. A method for simulating a candle flame comprising the steps of:

providing a lower light source that is configured to continuously emit a light of a first color and of a first intensity, said first intensity being a non-zero intensity over time;

an upper light source that is configured to continuously emit a light of a second color and of a second intensity, said second intensity being a non-zero and a substantially varying intensity over time; and where said second intensity is generated in response to a second intensity signal, said second intensity signal being a combination of a base intensity signal and a supplemental intensity signal and where said base intensity signal represents a non-zero intensity over time and where said supplemental intensity signal represents a substantially varying intensity over time and where said supplemental intensity signal is an aggregation of a plurality of individual intensity transition signals that each represent a separate varying intensity over time.

* * * * *